United States Patent [19]

Schwörer

[11] 4,290,576

[45] Sep. 22, 1981

[54] CLIMBING SCAFFOLDING

[75] Inventor: Artur Schwörer, Senden-Wullenstetten, Fed. Rep. of Germany

[73] Assignee: Peri-Werk Artur Schworer KG, Fed. Rep. of Germany

[21] Appl. No.: 21,406

[22] Filed: Mar. 19, 1979

[30] Foreign Application Priority Data

Apr. 6, 1978 [DE] Fed. Rep. of Germany ..... 2814930

[51] Int. Cl.[3] ..... E04B 11/22

[52] U.S. Cl. ..... 249/20; 249/22

[58] Field of Search ..... 249/20, 22

[56] References Cited

U.S. PATENT DOCUMENTS

| | | | |
|---|---|---|---|
| 3,583,666 | 6/1971 | Horstketter | 249/20 |
| 3,991,969 | 11/1976 | Oxyer | 249/20 |
| 4,016,228 | 4/1977 | Schmidt | 249/20 |
| 4,040,774 | 8/1977 | Scheller | 249/20 |
| 4,060,358 | 11/1977 | Fougea | 249/20 |
| 4,147,483 | 4/1979 | Rouera et al. | 249/20 |

*Primary Examiner*—John Parrish

*Attorney, Agent, or Firm*—William D. Hall

[57] ABSTRACT

In a climbing scaffolding or in a climbing formwork a guide rail (11) for the sole purpose of guiding the scaffolding during the lifting and lowering movements is provided, which is detachably secured to the concrete wall by at least two mounting parts (3, 4) for the climbing scaffolding section (6). This allows rapid lifting, and instead of a crane a lifting gear which is supported on the mounting parts can also be used for lifting.

16 Claims, 5 Drawing Figures

CLIMBING SCAFFOLDING

The present invention relates to a climbing scaffolding or a climbing formwork for concrete formworks in which the climbing scaffolding section is directly supported on mounting parts which are secured to a concrete wall. In climbing scaffoldings which are not self-climbing and which can be transferred by means of a crane, for example, according to DE-OS No. 22 17 584, it is known to support the formwork panels directly on the scaffolding section (working platform) and to fix the scaffolding section directly in the mounting parts (wall brackets, scaffolding shoes). In this known arrangement the scaffolding section including the formwork panels is upwardly displaced by one pouring section by means of a crane and again fixed in mounting parts which are anchored in the concrete wall. During this lifting operation, the scaffolding components are not guided but are freely suspended from the crane rope. The disadvantage of this arrangement consists in that, after the lifting operation, the scaffolding section must first be manually moved into such a position that the fixing means disposed on the scaffolding are brought to coincidence with corresponding fixing means disposed on the mounting part; in many cases, this is very time-consuming. It is only then that the scaffolding section can be anchored in the mounting part.

It is the object of the present invention to reduce the relatively expensive time during which the climbing scaffolding is hanging on the crane.

According to the invention this object is achieved in that, from the mounting part on which the scaffolding section including the formwork panels are supported to the mounting part which is disposed in the pouring section further towards the top, a guide rail for the sole purpose of guiding the scaffolding during its lifting movement by one pouring section is provided which can be detachably secured to at least two mounting parts.

The advantage of the present invention consists in that the scaffolding section is lifted substantially in parallel to itself and, by means of the guide rail which in the following is designated as rail, is brought into a position in which, in the lifted condition, the fixing means of the scaffolding section and of the mounting part are located in such a position relative to one another that the scaffolding section can be anchored in the mounting part without too much adjustment, for example by the insertion of pins into cutouts which are already in alignment or by putting wedges or the like underneath. Since said rail is only used for guiding the scaffolding section and since it must therefore sustain a relatively low bending load only, but not the load resulting from the weight of the scaffolding in the vertical direction, the rail may be of a relatively light construction so that, prior to the lifting of the scaffolding section, it can, for example, be manually brought into a position which connects the two mounting parts arranged one above the other. A further advantage of the present invention consists in that the scaffolding section must no longer be lifted by means of a crane but, due to its guidance in the rail, can also be lifted or lowered by means of an ordinary rope tackle block or other lifting gear which are supported on the mounting parts. The detachable connection of the rail to the mounting parts results in a simple rapid attachment of the rail because the rail must not be especially fixed to the concrete wall.

It is true that stanchions on which formwork panels are guided for vertical adjustment are known in self-climbing scaffoldings, but they are not only used for guidance when the formwork is being lifted but also for supporting heavy components and they must therefore be of an appropriately robust and consequently heavy design. In a formwork known, for example, from DE-OS No. 24 02 683, the formwork panels can be swivel mounted to the stanchion and they are supported via said stanchion on the mounting parts arranged in the concrete wall. Moreover, in this known formwork, the scaffolding containing the working platform is also detachably secured to said stanchion and supported via said stanchion on the mounting parts. Only after the setting of the concrete and of the formed wall section the formwork panels are retained in the wall via the clamping anchors. For the upward displacement of the panels these are disconnected from the stanchion, the stanchion is pushed upward and again fixed in the mounting parts in the higher position. Subsequently, the clamping anchors are released, the formwork panels are swivelled away from the wall and pushed upward together with the scaffolding portion at the stanchion (page 3, bottom, and page 4, top, DE-OS No. 24 02 683). The stanchion must therefore be of such a robust design that it can hardly or not at all be shifted by hand. Since the scaffolding section containing the working platform normally has no tension-proof connection with the formwork panels which can be swivelled relative to the scaffolding, the scaffolding portion containing the working platform—in case two lifting gears are not used—prior to the separation of the connection between the scaffolding section and the stanchion which is necessary for pushing up said stanchion, must be connected with the formwork panels retained at the completed wall by the clamping anchors in order that said scaffolding section, during the time in which it is not supported on the mounting parts via the stanchion, is retained in its elevated position. However, in the formwork according to the invention in which the scaffolding section is directly supported on the mounting part anchored in the wall, this is not necessary.

In one embodiment of the invention in which the mounting part is a channel section the yoke of which bears against the concrete wall, the rail extends in the space between the legs of the channel section. In climbing formworks which are hung in the mounting parts in the respectively desired height by means of a crane, mounting parts consisting of a channel section of this type are known and are frequently designated as scaffolding shoes. To enable the rail to run between the legs of the channel section, it is necessary that the legs of the channel section are lengthened as compared to the known scaffolding shoes. The advantage of this embodiment consists in that a particularly simple attachment of the rail in the desired defined position is possible.

For example, in case not a single rail but two rails running parallel to one another at a distance are provided for guidance, said rails can immediately bear against one of the legs of the channel section each. However, embodiments of the invention with only one single rail are preferred. This rail is preferably arranged in the center plane of the scaffolding bracket, i.e. in the axis of the forces occurring. In the case of an appropriate design, one single rail among others offers the advantage over two rails with approximately the same total cross section that the rail can additionally sustain higher lateral wind forces and that the guidance of the climbing scaffolding along the rail is simple.

In one embodiment of the present invention, an interspace is provided between the rail and at least one of the legs, and the climbing scaffolding (and/or the climbing formwork) has a projection which extends into the interspace. This arrangement offers the advantage that, in spite of the presence of the rail in the area of the mounting part, the projection can be anchored in the mounting part with its appropriately designed end portion.

In order to prevent that, during the displacement, the climbing scaffolding or the climbing formwork moves too far from the wall, some parts must be provided which embrace the rail. In case the climbing formwork is in its working position, these parts may be located at a distance from the mounting part. However, in one embodiment of the invention, it is provided that the projection embraces the rail so that the part for the anchorage in the mounting part simultaneously has the function of guidance along the rail.

The part of the climbing scaffolding for the anchorage in the mounting part is frequently designated as drop-in lug. In one embodiment of the invention it is provided that the drop-in lug which is used for the anchorage in the mounting part is penetrated by a vertical cutout through which the rail extends. If the drop-in lug is in the working position between the legs of the channel section—as it is generally the case with climbing formworks which can be relocated by crane—in this embodiment the rail is thus disposed at a distance from the two legs of the channel section.

The distance from the two legs of the channel section can be secured as desired. In one embodiment of the invention, the end portions of the rail have projections on the sides facing away from one another for securing the described interspace between the rail and the legs. In a development of the present invention, these projections may consist of bolts which can be removed, if required and which are connected to the rail in such a manner that an equally large portion projects from either side of the rail.

In connection with the particular embodiment in which the drop-in lug has a vertically extending cutout, the additional advantage here consists in that the described projections and/or the bolt forming these projections produce a captive connection between the rail and the climbing formwork and/or the climbing scaffolding so that, on the one hand, falling of the rail can be prevented in case it should slip out of the worker's hands when it is being pushed up and that, on the other hand, when the climbing scaffolding and/or the climbing formwork is being pushed up and also when it is being lowered, these projections constitute a stop which prevents that the climbing scaffolding and/or the climbing formwork can leave the guide formed by the rail.

The rail may be secured to the mounting parts in any desired manner, preferably by means of cotter pins; this facilitates rapid attachment and detachment of the rail.

In order to reduce the weight, according to one embodiment of the invention the rail is designed as a light-metal section bar. Preferably, the rail is designed as rectangular hollow section; this also includes square hollow sections.

Further features and advantages of the present invention will appear from the following description of an embodiment presented in the drawings which show essential features of the invention and from the claims. The individual features may be applied either individually or in any desired combination of a plurality of such features to one embodiment of the invention. In the drawings FIG. 1 is a side view of an embodiment of a climbing formwork according to the invention;

Figure 1:
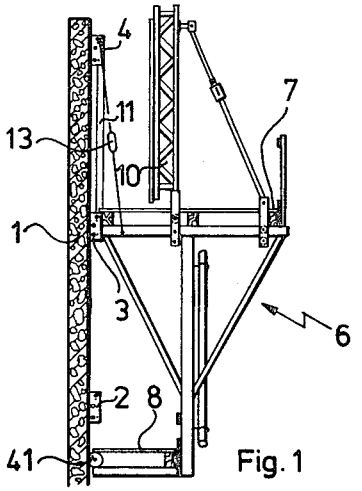

In FIG. 1 three mounting parts 2, 3 and 4, in the following designated as scaffolding shoes, are detachably secured to a concrete wall 1 at equal distances one above the other. It is pointed out that a climbing scaffolding is usually hung in at least two scaffolding shoes which are secured to the concrete wall at a horizontal lateral distance from one another; this side by side arrangement of the scaffolding shoes is not shown in the drawings. A climbing scaffolding 6 of a known configuration, having an upper working platform 7 and a lower working platform 8, is secured to the center scaffolding shoe 3. On the upper working platform 7 a formwork panel 10 which can be moved at right angles towards the concrete wall 1 is mounted in a known manner. Alternatively, any other formwork could also be arranged on climbing scaffolding 6. The ends of a rail 11 are secured to the scaffolding shoes 3 and 4. As soon as the concrete in the uppermost wall section has sufficiently set so that the scaffolding shoe 4 can be loaded, the climbing scaffolding 6 together with the formwork panel 10 carried by it can be lifted out of the scaffolding shoe 3 by means of a lifting gear 13, for example designed as tackle block, which acts on the climbing scaffolding and on the scaffolding shoe 4, and can then be lifted up to the scaffolding shoe 4 where said climbing scaffolding is fixed in its next higher position.

Figure 2:
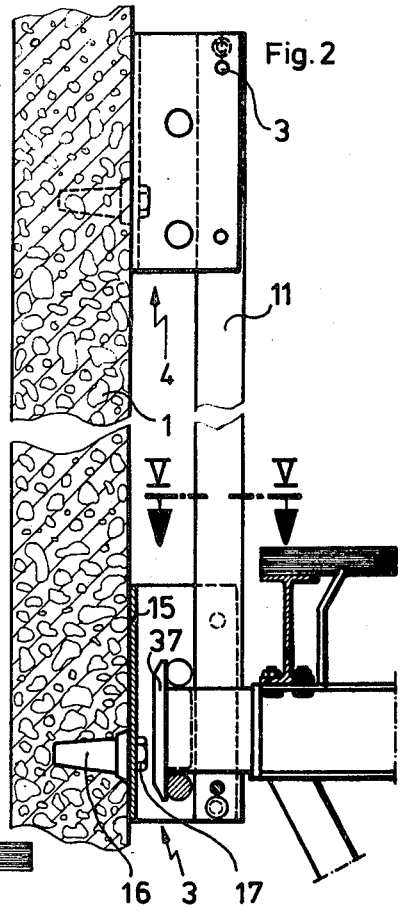
FIG. 2 is a side view which is greatly enlarged as compared to FIG. 1, the climbing scaffolding being only represented in the area of the scaffolding shoe in which it is anchored.

The details of the attachment of rail 11 to the scaffolding shoes and of the anchorage of the climbing scaffolding in the scaffolding shoes as well as the guidance by means of the rail are illustrated in the following FIGS. 2 through 5. The scaffolding shoe 3 has a channel section from metal which bears with its yoke 15 against concrete wall 1 and which is fixed in the usual manner by means of cone 16 and bolt 17. In FIG. 2 the scaffolding shoe 3 is represented partially broken. In the two legs 18 and 19 of scaffolding shoe 3 which are running at right angles to the surface of concrete wall 1, four holes each being in alignment with one another are provided, i.e. two holes 20 and 21 for the accommodation of load bearing pins 22 which are designed as cotter pins and two holes 23 and 24 of a smaller diameter for the attachment of rail 11. The holes 20 and 21 are located closer to the concrete wall 1, whereas the holes 23 and 24 are located closer to the free ends of the legs 18 and 19. Usually, in known scaffolding shoes an undetachably fixed pin is provided instead of a cotter pin which is inserted into the lower larger hole 20. In its lower end portion rail 11 is retained in the scaffolding shoe 3 via a cotter pin 25 which is inserted into the lower smaller hole 23 and in its upper end portion by a cotter pin which is inserted into the upper smaller hole 24 of the scaffolding shoe 4. For this purpose, rail 11 is provided with appropriate holes which, however, are not represented in the drawing. The holes 23 and 24 are arranged at a distance from the lower and/or upper face of the legs 18 and 19; in the portion below the lower hole 23 of the scaffolding shoe 3 and above the upper hole 24 of the scaffolding shoe 4, the rail 11 has an additional hole (not especially represented) through which a pin 27 is passed until its enlarged head bears against the outer surface of rail 11, said pin being secured by a cotter 28. The length of pin 27 is slightly smaller than the clear distance between the legs 18 and 19 so that the rail 11 has the same distance from the inner surfaces of the legs 18 and 19, i.e. it is centered.

The drop-in lug 31 is disposed in the extension of a girder 32 of the climbing scaffolding 6 and carries the upper working platform 7. The drop-in lug 31 has two plates 34 which are arranged at a horizontal distance parallel to one another, the clear distance of said plates being slightly larger than the width of rail 11 (represented as square hollow section); the plates 34 extend through the interspaces 35 and 36 between the rail 11 and the legs 18 and/or 19, the end faces of said plates being closer to the concrete wall 1 than the side of the rail 11 facing the concrete wall 1. The end faces of the plates 34 are connected with one another by a plate 37 which is arranged parallel to concrete wall 1, said plate upwardly and downwardly projecting over the plates 34 so that it embraces the two load carrying pins inserted in the cutouts 20 and 21 and thus firmly anchors the climbing scaffolding 6 in the scaffolding shoe 3. Between the two plates 34, immediately adjacent to the plate 37, an additional plate 38 is welded in, the surface of which, facing away from the concrete wall 1, constitutes a stop which together with the rail 11 prevents that, during the upward displacement, the climbing scaffolding 6 is moving too far away from the concrete wall 1 in the area of the drop-in lug 31. Thus, the plates 34, the plate 38 and the end of the girder 32 facing the concrete wall 1 limit a rectangular cutout 40 which vertically penetrates the drop-in lug 31 and the rail 11 extends through said cutout. Consequently, during the upward displacement, the drop-in lug 31 is guided by the rail 11 in such a manner that undesired lateral deviations are prevented both in the parallel and vertical direction to concrete wall 1.

Figure 3:
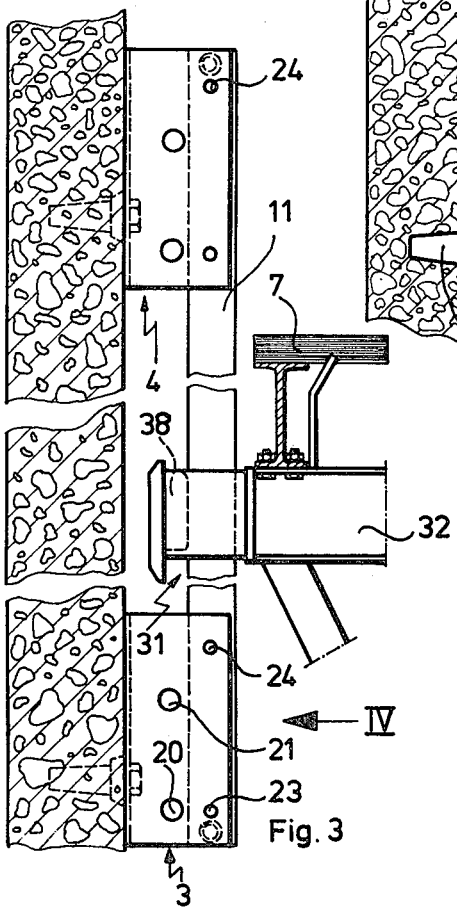
FIG. 3 is a view corresponding to FIG. 2, the climbing scaffolding being lifted into a position between two scaffolding shoes which are arranged one above the other.
Figure 4:
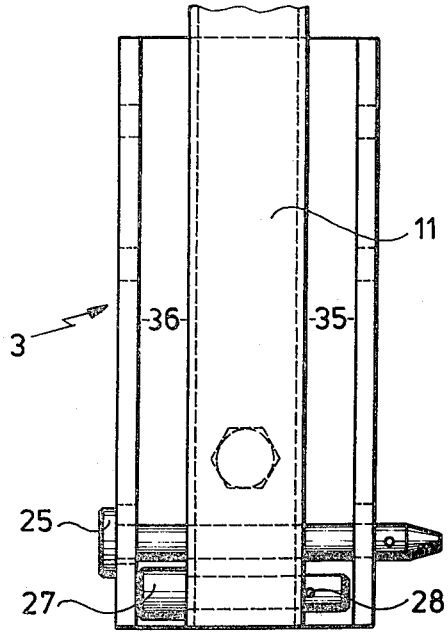
FIG. 4 is a view in the direction of arrow IV in FIG. 3 (enlarged as compared to FIG. 3)

Prior to the lifting of the climbing scaffolding 6, in the scaffolding shoe 3 in which the climbing scaffolding is anchored, the upper load carrying pin is withdrawn from cutout 21, as shown in FIG. 2. Subsequently, the climbing scaffolding 6 is lifted by means of the lifting gear which is not represented in FIGS. 2 through 5. During this lifting operation, a supporting roller 41 (FIG. 1) which is arranged in the vicinity of the lower working platform 8 prevents that the end of the girder for platform 8 which faces the concrete wall 1 rubs on the wall. The supporting roller 41 is arranged in a laterally shifted position relative to the scaffolding shoes so that it can roll past the lowermost scaffolding shoe 2 when the climbing scaffolding is being lifted. FIG. 3 shows the climbing scaffolding in a position between the two scaffolding shoes 3 and 4. The climbing scaffolding is sufficiently lifted until the drop-in lug 31 has attained a position slightly above the hole 20 in the upper scaffolding shoe 4; then a load carrying pin is inserted into this lower hole of the upper scaffolding shoe 4, subsequently the climbing scaffolding is slightly lowered so that a load carrying pin can also be inserted into the upper hole 21 of the scaffolding shoe 4 whereby the climbing scaffolding is anchored in the upper scaffolding shoe 4. Due to the presence of pin 27 at the uppermost end of the rail 11 inadvertent lifting of the climbing scaffolding 6 to such an extent that it would travel over the upper scaffolding shoe 4 is not possible. After the anchorage of the climbing scaffolding in the scaffolding shoe 4 the two cotter pins 23 in the scaffolding shoe 3 and cotter pin 24 in the scaffolding shoe 4 are removed and subsequently the rail 11 is manually shifted upward until its upper end can be anchored in another scaffolding shoe which is not represented and its lower end is fixed in scaffolding shoe 4. It is understood that the rail 11 may have a plurality of holes and that the holes can also be designed as oblong holes, in order to enable rail 11 to be anchored in the scaffolding shoes at any rate in spite of unavoidable differences in the distances between two scaffolding shoes which are arranged one above the other. While the rail 11 is being manually shifted upward, its ends are positively connected with the drop-in lug 31 by the two pins 27 so that falling down of the rail 11 is prevented in case it should slip out of the worker's hands.

The rail 11 is made from aluminium and in the embodiment it has an outer cross section of $60 \times 60$ mm and a wall thickness of 5 mm. In case the rail 11 has a length of 4 m this results in a weight of approximately 12 kg. It is also possible to use another cross section for rail 11, for example, a cross section of $60 \times 80$ mm; with a wall thickness of approximately 5 mm and a length of 4 m, this results in a weight of approximately 14 kg. In the case of a rectangular, i.e. not a square cross section, it may be useful to arrange the longer side at right angles to the plane of the concrete wall if it is anticipated that particularly high forces will act on the rail 11 at right angles to the wall. Due to the relatively low weight of rail 11 it is very easy to push up the rail by hand. It is a matter of course that, after the completion of the building, the climbing scaffolding can also be lowered again step by step by means of rail 11 without using a crane.

The present invention enables climbing scaffoldings which hitherto had been displaced by means of a crane to be converted to self-climbing scaffoldings by relatively simple modifications. The individual components of the self-climbing formwork can also be used for other formwork applications in which a climbing operation is not required.

The lifting gear may consist of rope tackle blocks or chain tackle blocks which can also be used for construction work in other places. An additional advantage is that the climbing scaffolding can climb through relatively large differences in height without stopping. In the embodiment a length of rail 11 of 4 m had been assumed, however, the length of the rail can easily be extended to 5 m, for example.

Another advantage consists in that the guide rail can be secured in an extremely simple manner to the scaffolding shoes which are already existing on the wall and that it is not necessary to secure the rail to the wall additionally. Since the rail is arranged at a distance from the wall, refinishing operations can be performed on the wall behind the rail.

A further advantage consists in that only one additional mounting part is required for each climbing step of, for example, 4 m or 5 m, i.e. not more mounting parts than are required for the known climbing scaffoldings which can be displaced by crane.

The clearance between the rail 11 and the boundary of cutout 40 in the drop-in lug 31 is designed so that, on the one hand, adequate guidance by the rail during the displacement of the climbing scaffolding is achieved, however, that, on the other hand, a certain deviation from the perpendicular is possible when the rail is being pushed up, without the displacement of the rail being impeded all too much.

During the climbing operations, the pins 27 are not removed from the rail 11, but only when the scaffoldings are erected for the first time to enable the rail to be threaded into the cutout 40, and after the completion of the building when the scaffoldings are being disassembled.

Figure 5:
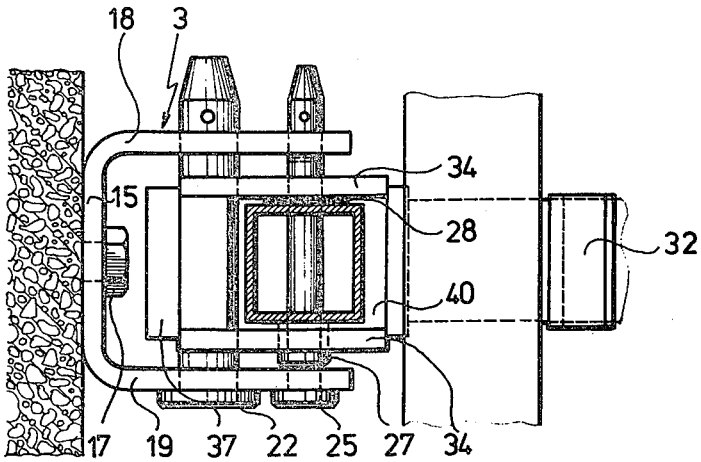
FIG. 5 is a sectional view taken along the line V/V in FIG. 2 on the same scale as FIG. 4.

As FIG. 5 shows, the rail 11 is located exactly in the perpendicular center plane of the girder 32 which is a part of the scaffolding bracket of the climbing scaffolding 6, said center plane running at right angles to the outer side of concrete wall 1.

Having thus fully described my invention, what I claim as new and wish to secure by Letters Patent is:

1. In a climbing scaffolding device, said scaffolding device being attachable to a wall of a structure:

a scaffolding platform, framework means for supporting said scaffolding platform, connecting means for attaching said framework means to said wall, the improvement comprising:

said connecting means including at least two projections extending from and supported by said wall, said projections being spaced apart vertically, said framework means comprising an engaging member that may be attached to either of said projections, said framework means being constructed and arranged to enable it to be detached from one of said projections, moved to a position adjacent the other of said projections, and then attached to said other projection, and guide means separate from and in addition to the engaging member for guiding the framework means between said projections while the framework means is being moved from the one to the other of said projections, said guide means extending between and being removably attached to said projections.

2. A climbing scaffolding device according to claim 1, wherein each projection includes two holes spaced apart vertically, said connecting means includes two pins which may be respectively inserted in said two holes, said engaging member includes means engaged by said pins for holding the engaging member in a fixed position.

3. A climbing scaffolding device according to claim 2 wherein said framework means including a horizontal beam member, said engaging member being located at one end of said horizontal beam member, said means for engaging said pins including an engaging place affixed to said one end of said horizontal member, said engaging plate abutting said pins to limit horizontal movement of said engaging member, said horizontal beam and said connecting means being constructed and arranged such that the horizontal beam is received between said pins.

4. A climbing scaffolding device according to claim 3 wherein said horizontal member has a hole therein to receive said guide means.

5. A climbing scaffolding device according to claim 4 wherein said projections comprise channel shaped bracket means, said bracket means having a yoke portion along the face of the wall and attached to the wall and also having a portion extending away from the wall, said portion having said holes therein to receive said pins.

6. A climbing scaffolding device according to claim 5 wherein said bracket means have a length not greater than one foot and are spaced not less than five feet apart.

7. A climbing scaffolding device according to claim 1 comprising removable pins, said guide means being attached to said projections by said removable pins.

8. A climbing scaffolding device according to claim 1 wherein said guide means is a guide rod and is parallel to and spaced from said wall when said guide rod is attached to two of said projections.

9. A climbing scaffolding device according to claim 8 wherein said guide rod is a non-load bearing member when said framework means is attached to one of said projections.

10. A climbing scaffolding device according to claim 9 wherein said guide rod has a length no greater than the distance between said projections when said projections are attached to said wall.

11. A climbing scaffolding device according to claim 9 wherein said guide rod comprises a metal tube.

12. A climbing scaffolding device according to claim 1 further comprising a second scaffolding platform supported by said framework means, said second scaffolding platform being located below and spaced from said first scaffolding platform, said second scaffolding platform having a wheel which abuts and runs along said wall.

13. A climbing scaffolding device according to claim 1 further comprising:

a lifting assembly means for moving said framework means between two of said projections, said lifting assembly means being attached to the framework means and one of said projections.

14. A climbing scaffolding device according to claim 1 further comprising concrete formwork supported by said framework means.

15. A climbing scaffolding device according to claim 14 wherein the formwork is movably mounted on said framework means.

16. A climbing scaffolding device according to claim 15 wherein said climbing scaffolding is employed in pouring and forming a concrete wall, a portion of which concrete has hardened, said connecting means including means which was embedded in said wall when said wall was poured, and wherein when the concrete abutting said formwork has hardened said scaffolding device may be moved from one projection to another projection.

* * * * *

UNITED STATES PATENT AND TRADEMARK OFFICE

CERTIFICATE OF CORRECTION

PATENT NO. : 4,290,576

DATED : September 22, 1981

INVENTOR(S) : Artur Schwörer

It is certified that error appears in the above-identified patent and that said Letters Patent are hereby corrected as shown below:

On the title page the assignee should read as follows:

--[73] Assignee: Peri-Werk Artur Schwörer KG, Fed. Rep. of Germany --.

Signed and Sealed this

Sixteenth Day of March 1982

[SEAL]

Attest:

GERALD J. MOSSINGHOFF

Attesting Officer

Commissioner of Patents and Trademarks